US009257254B2

(12) United States Patent
Ogura et al.

(10) Patent No.: US 9,257,254 B2
(45) Date of Patent: Feb. 9, 2016

(54) TRANSMISSIVE TARGET, X-RAY GENERATING TUBE INCLUDING TRANSMISSIVE TARGET, X-RAY GENERATING APPARATUS, AND RADIOGRAPHY SYSTEM

(71) Applicant: CANON KABUSHIKI KAISHA, Tokyo (JP)

(72) Inventors: Takao Ogura, Yokohama (JP); Shuji Yamada, Atsugi (JP); Masatoshi Watanabe, Isehara (JP); Takeo Tsukamoto, Kawasaki (JP); Yoichi Ikarashi, Fujisawa (JP); Tadayuki Yoshitake, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 14/301,233

(22) Filed: Jun. 10, 2014

(65) Prior Publication Data

US 2014/0369471 A1 Dec. 18, 2014

(30) Foreign Application Priority Data

Jun. 14, 2013 (JP) ..... 2013-125847

(51) Int. Cl.
*H01J 35/08* (2006.01)
*H05G 1/06* (2006.01)

(52) U.S. Cl.
CPC ..... *H01J 35/08* (2013.01); *H01J 2235/081* (2013.01); *H01J 2235/087* (2013.01); *H01J 2235/1204* (2013.01); *H01J 2235/1291* (2013.01); *H05G 1/06* (2013.01)

(58) Field of Classification Search
CPC ..... H01J 35/08; H01J 2235/1291; H01J 2235/087; H01J 2235/1204; H01J 2235/081; H05G 1/06
USPC ..... 378/62, 119, 121, 143
See application file for complete search history.

(56) References Cited

U.S. PATENT DOCUMENTS

2012/0318987 A1* 12/2012 Miyazaki ..... H01J 35/08 250/358.1
2013/0195246 A1* 8/2013 Tamura ..... H01J 35/12 378/62

FOREIGN PATENT DOCUMENTS

JP 2002-298772 A 10/2002
JP 2009-545840 A 12/2009
JP 2012-256444 A 12/2012

* cited by examiner

*Primary Examiner* — Courtney Thomas
(74) *Attorney, Agent, or Firm* — Canon U.S.A. Inc., IP Division

(57) ABSTRACT

A transmissive target includes a target layer configured to include target metal and generate X-ray when receiving electrons and a substrate configured to support the target layer and include carbon as a main component. A carbide region including carbide of the target metal and a non-carbide region including the target metal are disposed in a mixed manner on a boundary surface between the substrate and the target layer on a target layer side.

10 Claims, 7 Drawing Sheets

9

9

TRANSMISSIVE TARGET, X-RAY GENERATING TUBE INCLUDING TRANSMISSIVE TARGET, X-RAY GENERATING APPARATUS, AND RADIOGRAPHY SYSTEM

BACKGROUND OF THE INVENTION

1. Field of the Invention

The present invention relates to transmissive targets and X-ray generating apparatuses which are suitably applied to diagnosis application, nondestructive radiography, and the like in fields of medical equipment and industrial equipment.

The present invention particularly relates to a transmission X-ray target including a target layer and a diamond substrate which supports the target layer. The present invention further relates to an X-ray generating tube including the transmission X-ray target, an X-ray generating apparatus including the X-ray generating tube, and an X-ray imaging system including the X-ray generating apparatus.

2. Description of the Related Art

In X-ray generating apparatuses which generate X-rays and which are used for medical diagnosis, there is a demand for improvement of operability of the apparatuses by improving durability and facilitating maintenance so that medical modality which is applicable to home medical care and emergency medical care in cases of disasters and accidents is realized.

Main factors of determining durability of X-ray generating apparatuses include heat resistance of a target serving as an X-ray generating source.

In X-ray generating apparatuses which generate X-ray by irradiating an electron beam to a target, "X-ray generating efficiency" of the target is smaller than 1%, and therefore, most energy supplied to the target is converted into heat. When dissipation of heat generated by the target is not sufficiently performed, an adhesion property of the target is deteriorated due to thermal stress, and accordingly, the heat resistance of the target is restricted.

As a method for improving the "X-ray generating efficiency" of the target, a transmissive target including a target layer of a thin film including heavy metal and a substrate which allows X-ray to be transmitted and which supports the target layer is widely used. Japanese Patent Laid-Open No. 2009-545840 discloses a rotating anode transmissive target having "X-ray generating efficiency" increased by 1.5 times or more relative to a rotating anode reflection target in the related art.

Furthermore, as a method for encouraging external "dissipation of heat" from the target, application of diamond to a substrate which supports a target layer of a lamination target is widely used. Japanese Patent Laid-Open No. 2002-298772 discloses improvement of a heat X-ray property and realization of microfocus by using diamond as a substrate which supports a target layer including tungsten. The diamond is suitable for a support substrate for supporting a transmissive target since the diamond has a high X-ray transmission property in addition to high durability and high thermal conductivity.

However, the diamond has low wettability relative to molten metal and a linear expansion coefficient which mismatches that of solid metal, and accordingly, compatibility with target metal is low. Therefore, to ensure an adhesion property between the target layer and the diamond substrate is an issue to improve reliability of the transmissive target.

Japanese Patent 2002-298772 discloses generation of thermal stress between a target layer and a diamond substrate caused by mismatch of linear expansion coefficients in an X-ray generating tube including a transmissive target and occurrence of peeling and generation of crack in the target layer caused by the thermal stress. According to Japanese Patent Laid-Open No. 2002-298772, since the target layer leans toward the diamond substrate, the target layer is pushed toward the diamond substrate at a time of operation of the X-ray generating tube so that the target layer is prevented from being peeled.

Japanese Patent Laid-Open No. 2012-256444 discloses occurrence of variation of output caused by thermal resistance generated between a diamond substrate and a target layer in an X-ray generating tube including a transmissive target, which is a problem to be solved. According to Japanese Patent Laid-Open No. 2012-256444, since the target layer and a metal carbide layer of metal for forming solid solution are inserted between the target layer and the diamond substrate, an adhesion property between the target layer and the diamond substrate is improved so that the variation of output of X-ray is suppressed.

Even when the transmissive target including the metal carbide layer inserted between the target layer and the diamond substrate is used as the structure disclosed in Japanese Patent Laid-Open No. 2012-256444, variation of output of X-ray may occur since the adhesion property of the target is not sufficiently maintained for a long period of time.

SUMMARY OF THE INVENTION

Accordingly, the present invention provides an X-ray generating tube, an X-ray generating apparatus, and an X-ray imaging system which are capable of suppressing variation of X-ray output intensity and realizing stable X-ray output by maintaining an adhesion property between a target layer and a diamond substrate for a long period of time.

A transmissive target according to the present invention includes a target layer configured to include target metal and generate X-ray when receiving irradiated electrons and a substrate configured to support the target layer and include carbon as a main component. A carbide region including carbide of the target metal and a non-carbide region including the target metal are disposed in a mixed manner on a boundary surface between the substrate and the target layer on a target layer side.

Further features of the present invention will become apparent from the following description of exemplary embodiments with reference to the attached drawings.

DESCRIPTION OF THE EMBODIMENTS

Figure 1B:
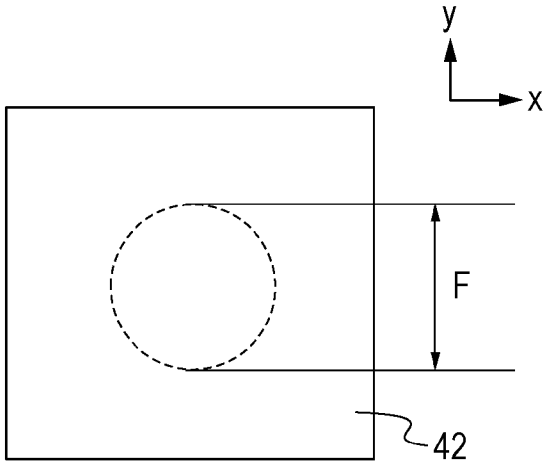
FIGS. 1A to 1C are sectional views schematically illustrating a basic configuration of a transmissive target according to the present invention.

A problem to be solved in the present invention relates to a layered structure of a "transmissive target" which is applicable to an X-ray generating apparatus.

First, a "transmission type" of the target according to the present invention will be described.

In the present invention, the term "transmissive target" simply represents a form of a structure including "a target layer including target metal which generates X-ray with irradiation of electrons and a support substrate which supports the target layer".

Alternatively, the term "transmissive target" is used in this specification so as to simply represent a form of an operation of "X-ray generated in a target layer to an opposite side relative to a surface of the target layer which receives electrons".

In the transmissive target, a thickness of a target layer which is substantially equal to a depth of intrusion of an electron beam at a time of operation of the target is selected taking suppression of self attenuation of X-ray in a direction of the thickness of the target layer into consideration. In general, as the thickness of the target layer, a range from 0.1 mm to 10 mm is selected in a reflection target whereas a range of 2 μm to 20 μm is selected in the transmissive target. Furthermore, in the transmissive target, since the target layer is a thin film, the target layer is difficult to stand alone, and therefore, the target layer is supported by a substrate which allows X-ray to be transmitted. Also in the present invention, a problem caused by the lamination layer structure of the transmissive target is addressed.

In this specification, the transmissive target is referred to as a "target" hereinafter which is different from general reflection targets applied to general modality. In the transmissive target including "a metal carbide layer inserted between a target layer and a diamond substrate" disclosed in Japanese Patent Laid-Open No. 2012-256444, variation of output of X-ray is detected when the transmissive target is operated while current density on the target layer is set high. Here, the case where the current density of the target layer is set high includes a case where an X-ray tube current is increased by making a flux of electron beams be in microfocus in order to ensure resolution and an image contrast of a medical diagnosis image.

The inventors have discussed a cause of such variation of output of X-ray, and as a result, the following conclusion is obtained.

As disclosed in Japanese Patent Laid-Open No. 2012-256444, since the metal carbide layer has compatibility with the diamond substrate, an anchoring effect is realized and the adhesion property of the transmissive target is improved. However, the inventors have found that the metal carbide layer is a factor of generation of thermal stress caused by mismatch between linear expansion coefficients of the metal carbide layer and the diamond substrate.

It is estimated that the variation of output of X-ray described above occurs since heat transfer from the target layer to the diamond substrate is blocked due to microscopic deterioration of the adhesion property caused by thermal stress generated between the metal carbide layer and the diamond substrate. The present invention addresses the problem relating to deterioration of an adhesion property caused by a metal carbide layer by employing a certain structure as a layer structure of a transmissive target.

Hereinafter, embodiments of the present invention will be described in detail with reference to the accompanying drawings. Sizes, materials, forms of components and relative arrangement of the components described in the embodiments do not limit the scope of the present invention.

Figure 3A:
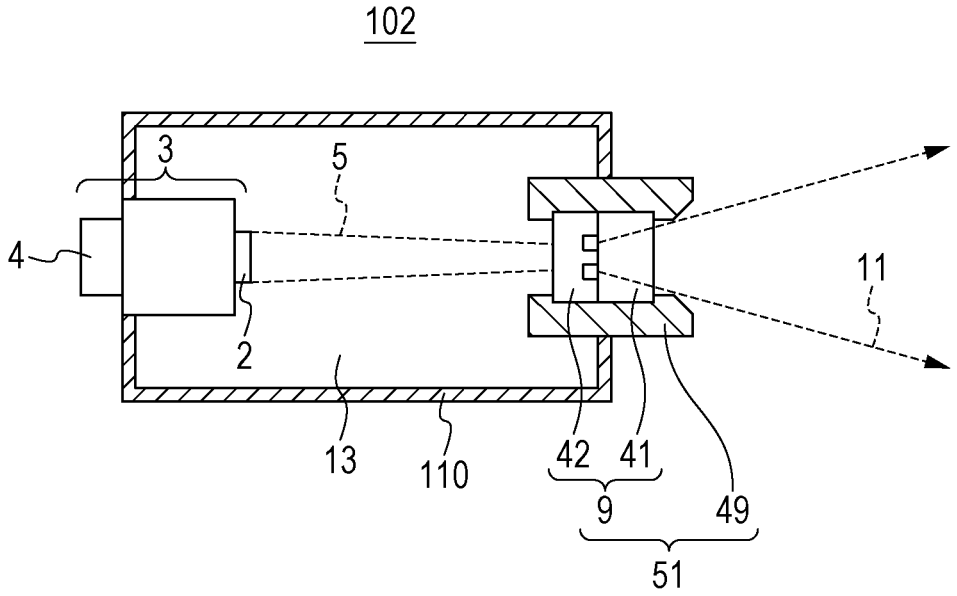
FIG. 3A is a diagram schematically illustrating a configuration of an X-ray generating tube to which the target of the present invention is applied.
Figure 3B:
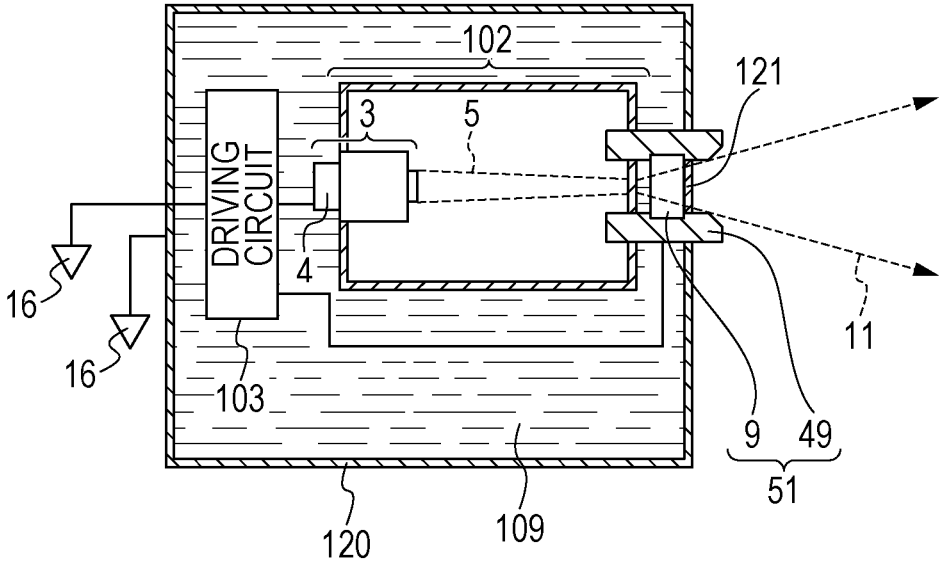
FIG. 3B is a diagram illustrating a configuration of an X-ray generating apparatus to which the target is applied.

FIGS. 3A and 3B are sectional views illustrating a configuration of an X-ray generating tube including a target according to the present invention and a configuration of an X-ray generating apparatus, respectively.

X-Ray Generating Tube

In FIG. 3A, an embodiment of a transmission X-ray generating tube 102 including an electron emitting source 3 and a target 9 which faces the electron emitting source 3 in a separated manner is illustrated.

In this embodiment, a flux of electron beams 5 irradiated from an electron emitting portion 2 included in the electron emitting source 3 is encountered to a target layer 42 of the target 9 so that an X-ray flux 11 is generated.

Electrons included in the flux of electron beams 5 are accelerated up to an incident energy required for generating X-ray by an accelerating electric field interposed between the electron emitting source 3 and the target layer 42. The accelerating electric field is formed in an inner space 13 of the X-ray generating tube 102 by a driving circuit 103 which outputs an X-ray tube voltage Va and a cathode and an anode which are electrically connected to the driving circuit 103. Specifically, the X-ray tube voltage Va output from the driving circuit 103 is applied to a portion between the target layer 42 and the electron emitting portion 2.

In this embodiment, the target 9 includes a target layer 42 and a diamond substrate 41 which supports the target layer 42 as illustrated in FIG. 3A. A target unit 51 at least includes the target 9 and an anode member 49 and functions as an anode of the X-ray generating tube 102.

Embodiments of the target 9 and the target unit 51 will be described in detail hereinafter.

The inner space 13 of the X-ray generating tube 102 has vacuum atmosphere so that an electron mean free path is ensured. A degree of vacuum in the inside of the X-ray generating tube 102 is preferably equal to or larger than $10^{-8}$ Pa and equal to or smaller than $10^{-4}$ Pa, and more preferably, equal to or larger than $10^{-8}$ Pa and equal to or smaller than $10^{-6}$ Pa in terms of durability of the electron emitting source 3.

Reduction of pressure of the inside of the X-ray generating tube 102 is realized by a method for performing evacuation by a vacuum pump, not illustrated, through an exhaust pipe, not illustrated, and thereafter, sealing the exhaust pipe. Furthermore, in the inside of the X-ray generating tube 102, a getter, not illustrated, may be disposed to maintain the degree of vacuum.

The X-ray generating tube 102 includes an insulation tube 110 in a body thereof which attains electric insulation between the electron emitting source 3 serving as a cathode potential and the target layer 42 serving as an anode potential. The insulation tube 110 is including an insulating material such as a glass material or a ceramic material. In this embodiment, the insulation tube 110 has a function of defining a gap between the electron emitting source 3 and the target layer 42.

The X-ray generating tube 102 is preferably includes an envelope having airtightness and anti-atmospheric pressure strength for maintaining the degree of vacuum. In this embodiment, the envelope is constructed by the insulation tube 110, the cathode including the electron emitting source 3, and the anode including the target unit 51. The electron emitting portion 2 and the target layer 42 are disposed in the inner space 13 of the envelope or an inner surface of the envelope.

Here, in this embodiment, the diamond substrate 41 serves as a transmission window for extracting X-ray generated in the target layer 42 from the X-ray generating tube 102 and also serves as a component of the envelope.

The electron emitting source 3 is disposed so as to face the target layer 42 included in the target 9. As the electron emitting source 3, a hot cathode such as a tungsten filament or an impregnated cathode or a cold cathode such as a carbon nanotube may be used. The electron emitting source 3 may include a grid electrode or an electrostatic lens electrode, not illustrated, so as to control a beam diameter of the flux of electron beams 5, electronic current density, and on/off timings.

X-Ray Generating Apparatus

An embodiment of an X-ray generating apparatus 101 which irradiates the X-ray flux 11 from an X-ray transmission window 121 as an X-ray is illustrated in FIG. 3B. The X-ray generating apparatus 101 of this embodiment includes the X-ray generating tube 102 serving as an X-ray source and the driving circuit 103 which drives the X-ray generating tube 102 in an accommodation container 120 having the X-ray transmission window 121.

The driving circuit 103 illustrated in FIG. 3B supplies the X-ray tube voltage Va to the portion between the target layer 42 and the electron emitting portion 2. The appropriate X-ray tube voltage Va is selected depending on a thickness and target metallic species of the target layer 42 so that the X-ray generating apparatus 101 which generates required types of beam is attained.

The accommodation container 120 which accommodates the X-ray generating tube 102 and the driving circuit 103 preferably has sufficient intensity as a container and has an excellent property of heat dissipation. The accommodation container 120 is made by metal material such as brass, iron, or stainless steel.

The X-ray generating apparatus 101 of this embodiment is an anode-grounded X-ray generating apparatus. In this embodiment, the accommodation container 120 and the target unit 51 serving as the anode are electrically connected to each other, and the accommodation container 120 is connected to grounded terminals 16. The grounded form is not limited to this, and cathode ground or intermediate potential ground may be employed.

In this embodiment, insulation liquid 109 is filled in a region included in the accommodation container 120 other than regions corresponding to the X-ray generating tube 102 and the driving circuit 103. The insulation liquid 109 has electrical insulation and has a function of maintaining electrical insulation in the accommodation container 120 and a function of a cooling medium. As the insulation liquid 109, electrical insulation oil such as mineral oil, silicone oil, or perfluoro oil is preferably used.

Radiography System

Next, an example of a configuration of an X-ray imaging system including the target according to the present invention will be described with reference to FIG. 3C.

A system control unit 202 integrally controls the X-ray generating apparatus 101 and an X-ray detector 206. The driving circuit 103 outputs various control signals to the X-ray generating tube 102 under control of the system control unit 202. Although the driving circuit 103 is accommodated in the accommodation container 120 included in the X-ray generating apparatus 101 together with the X-ray generating tube 102 in this embodiment, the driving circuit 103 may be disposed outside the accommodation container 120. A state of irradiation of the X-ray flux 11 irradiated from the X-ray generating apparatus 101 is controlled by a control signal output from the driving circuit 103.

The X-ray flux 11 irradiated from the X-ray generating apparatus 101 is output from the X-ray generating apparatus 101 while an irradiation range thereof is controlled by a collimator unit, not illustrated, including a movable diaphragm, transmitted through a subject 204, and detected by the X-ray detector 206. The X-ray detector 206 converts the detected X-ray into an image signal to be supplied to a signal processor 205.

The signal processor 205 performs a certain signal process on the image signal under control of the system control unit 202 and outputs the processed image signal to the system control unit 202.

The system control unit 202 outputs a display signal used to display an image in a display device 203 in accordance with the processed image signal.

The display device 203 displays the image based on the display signal as a photographed image of the subject 204 in a screen.

A representative example of the radiation according to the present invention is an X-ray, and the X-ray generating apparatus 101 and the X-ray imaging system according to the present invention may be used as an X-ray generating unit and an X-ray photographing system, respectively. The X-ray photographing system may be used in nondestructive inspection to be performed on industrial products and pathological diagnosis for human bodies and animals.

Target

Next, a basic configuration and a basic operation state of the target according to an embodiment of the present invention will be described with reference to FIGS. 1A to 1D.

Figure 1A:
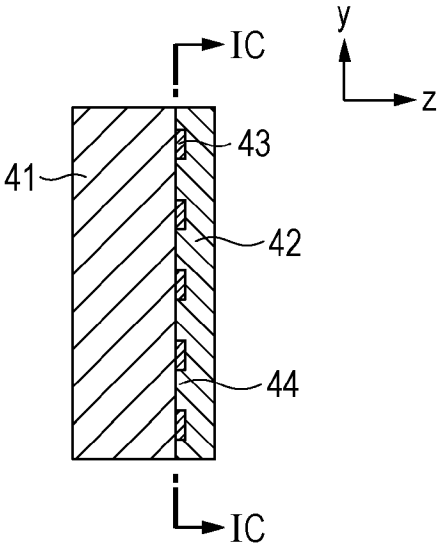
Figure 1D:
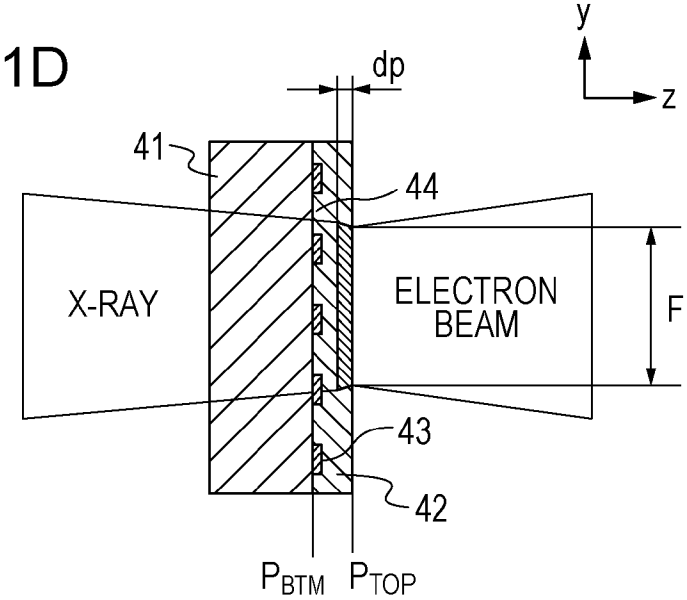
FIG. 1D is a sectional view schematically illustrating an operation state of the transmissive target.
Figure 1C:
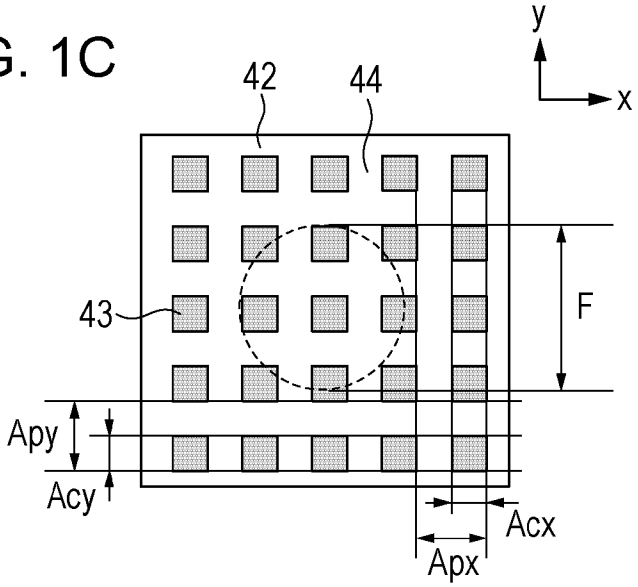

Here, FIG. 1A is a vertical sectional view illustrating a layered structure of the target 9 according to this embodiment. FIG. 1C is a transverse sectional view of the target 9 which is virtually cut the target 9 along an instruction line IC illustrated in FIG. 1A. FIGS. 1B and 1D are a plan view and a vertical sectional view, respectively, illustrating an operation state of the target 9. FIG. 1B is a plan view obtained when the target 9 illustrated in FIG. 1D is viewed from the target layer 42.

As illustrated in FIG. 1A, the target 9 at least includes the target layer 42 including target metal and the substrate 41 which supports the target layer 42. The substrate 41 is including carbon as a main component. With this configuration, the substrate 41 has radiability. Furthermore, the substrate 41 is including a material including sp3 carbon bond as a main bonding skeleton. With this configuration, the substrate 41 has heat resistance and thermal conductivity. By this, the transmissive target 9 illustrated in FIG. 1D may be configured.

The substrate 41 is including diamond or diamond-like carbon (DLC), for example. Furthermore, a carbon skeleton of the substrate 41 preferably has crystallinity of a pyramid structure of sp3 bonding which is thermally stable, and crystallinity of single crystal or crystallinity of polycrystal may be employed. Here, the substrate 41 having diamond or DLC as a main component and further having gas or metal including nitrogen, vanadium, or the like as a minor component may be also included in an embodiment of the present invention.

A thickness of the substrate 41 is determined taking attenuation of X-ray generated by the target layer 42 and thermal conductivity in a direction orthogonal to the thickness into consideration, and the thickness in a range from 100 μm to 2 mm may be selected.

The target layer 42 includes a metallic element having a high atomic number, a high melting point, and high density as target metal. As the target metal, at least one of metals which is selected from a group of tantalum, molybdenum, and tungsten having negative standard free energy of formation of carbide is preferably used in terms of compatibility with the diamond substrate 41. The target metal may be a single composition, an alloy composition, or an intermetallic compound.

The thickness of the target layer 42 is determined in accordance with a depth dp of intrusion of electrons to the target layer 42, which will be described in detail hereinafter. Taking an X-ray tube voltage Va of an X-ray generating tube used for medial X-ray diagnosis into consideration, the thickness of the target layer 42 is typically selected in a range from 1 μm inclusive to 20 μm inclusive, and preferably selected in a range from 1.5 μm inclusive to 12 μm inclusive.

Next, carbide regions 43 according to the present invention will be described with reference to FIGS. 1A to 1D, FIGS. 2A to 2D, and FIGS. 4A to 4F. The carbide regions 43 are locally disposed between the substrate 41 and the target layer 42 so as to reduce thermal stress generated in the target 9.

FIGS. 1A to 1D are diagrams illustrating a basic embodiment of the target 9 of the present invention. The target 9 of this embodiment has a cross section in which regions including the carbide regions 43 and regions which do not include the carbide regions 43 are alternately disposed in a coupling surface between the substrate 41 and the target layer 42 as illustrated in FIG. 1A. According to the present invention, the regions in which the target layer 42 and the substrate 41 are laminated without the carbide regions 43 are referred to as non-carbide regions 44 of the target 9.

In this embodiment, as illustrated in FIG. 1B, the carbide regions 43 are arranged in a matrix with the non-carbide regions 44 interposed therebetween. According to this embodiment, since the configuration in which the carbide regions 43 and the non-carbide regions 44 which have boundaries in a plurality of directions are mixed is employed at least in an electron irradiation region F, thermal stress generated in the plurality of directions may be reduced. In this embodiment, the term "plurality of directions" represents a plurality of directions which are not parallel to one another or not antiparallel to one another. Furthermore, in this embodiment, the electron irradiation region F represents a range which receives irradiation of electrons and which is defined on the target layer 42 by the flux of electron beams 5.

Figure 2B:
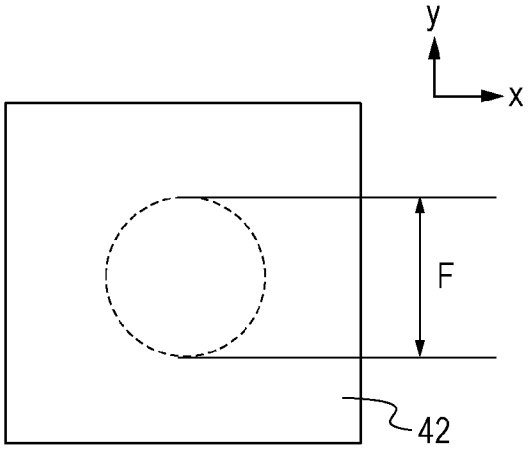
FIGS. 2A to 2C are sectional views schematically illustrating another basic configuration of the transmissive target according to the present invention.
Figure 2A:
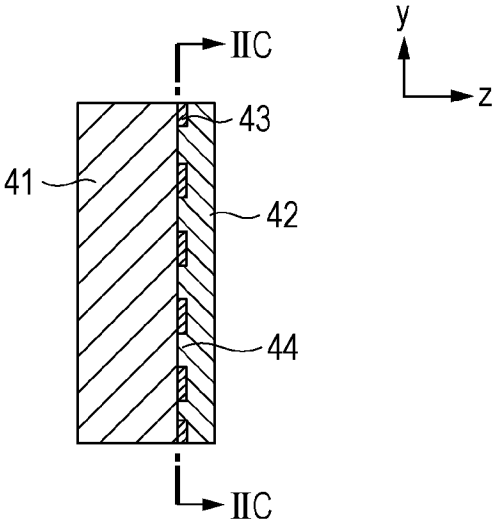
Figure 2D:
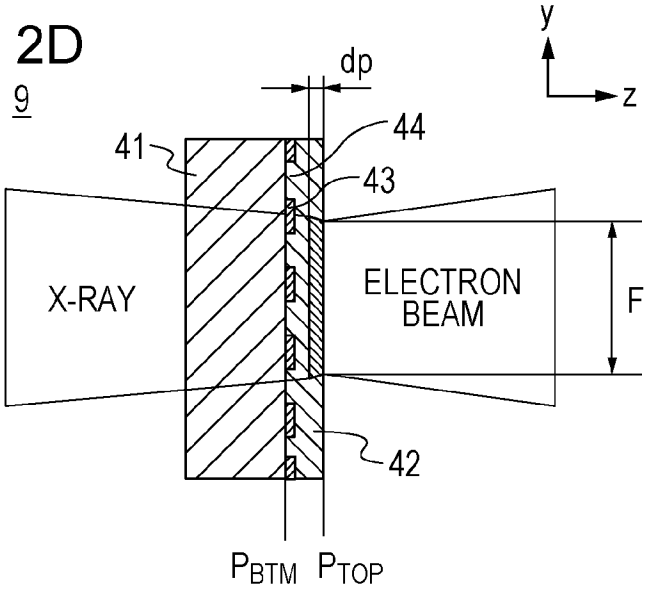
FIG. 2D is a sectional view schematically illustrating an operation state of the transmissive target.
Figure 2C:
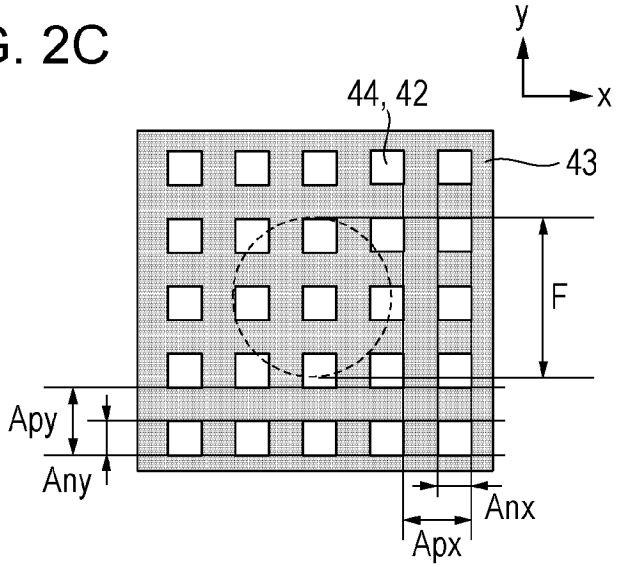

In this embodiment, the carbide regions 43 are disposed between the substrate 41 and the target layer 42 as a discontinuous layer. However, it is not necessarily the case that the carbide regions 43 are discretely disposed in an in-plane direction of a layer which is parallel to the target layer 42. For example, as illustrated in FIG. 2C, a configuration in which a carbide region 43 is formed as a single continuous region and the non-carbide regions 44 are discretely disposed in the in-plane direction of a layer is also included in an embodiment of the present invention.

FIGS. 2A to 2D are diagrams illustrating a modification of the configuration illustrated in FIGS. 1A to 1D. The arrangement of the carbide regions 43 and arrangement of the non-carbide regions 44 of FIGS. 1A to 1D are reversed in FIGS. 2A to 2D. FIGS. 2A to 2D correspond to FIGS. 1A to 1D, respectively. In this embodiment, the carbide regions 43 are locally separated by the non-carbide regions 44 and continuity of the arrangement of the carbide regions 43 is locally lost. Also in this embodiment, the carbide regions 43 which are locally disposed have a function of reducing the thermal stress of the target 9.

Other modifications of the arrangement of the carbide regions 43 and the non-carbide regions 44 according to the present invention will be descried with reference to FIGS. 4A to 4F.

Figure 4A:
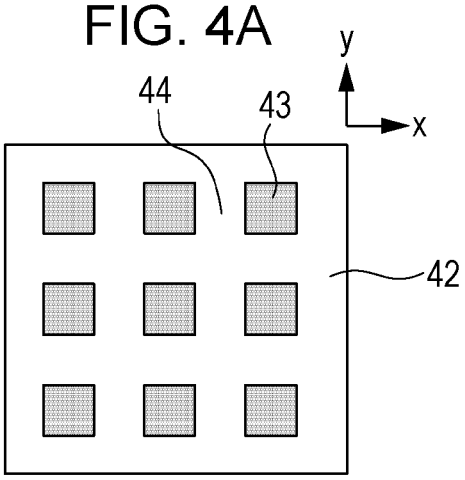
FIGS. 4A to 4F are transverse sectional views illustrating modifications of the target according to the present invention.
Figure 4D:
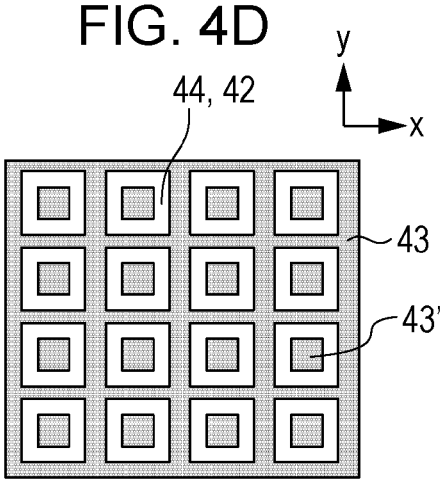
Figure 4B:
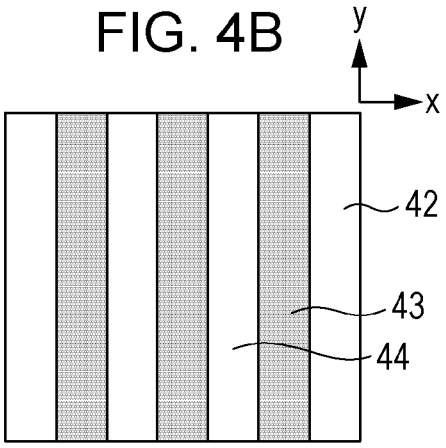
Figure 4E:
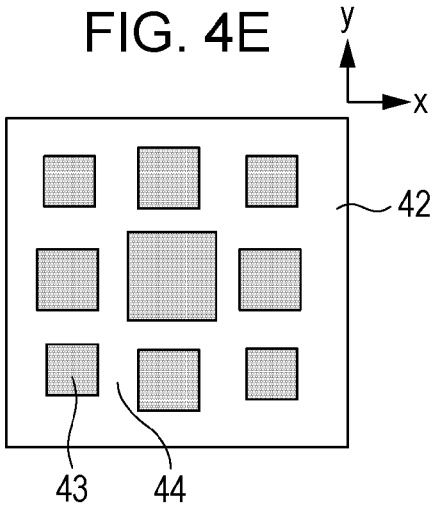
Figure 4C:
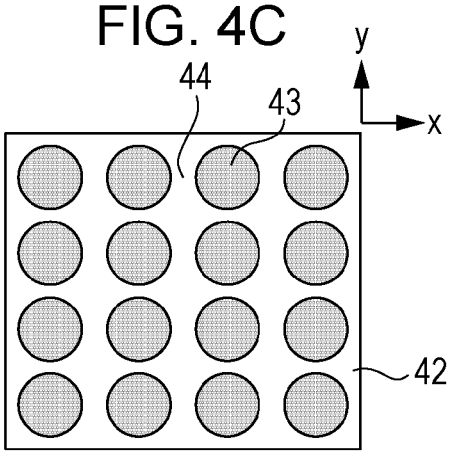

Embodiments illustrated in FIGS. 4A, 4C, and 4E are modifications of the embodiment illustrated in FIGS. 1A to 1D. FIG. 4A is a diagram illustrating an embodiment in which square carbide regions 43 having the same size are arranged in a matrix, and FIG. 4C is a diagram illustrating an embodiment in which circular carbide regions 43 having the same size are arranged in a matrix. FIG. 4E is a modification of the embodiment illustrated in FIG. 1A. In the modification, square carbide regions 43 having different sizes depending on distances from the center of a focus point of an electron beam are arranged in a matrix.

Furthermore, in an embodiment illustrated in FIG. 4B, the carbide regions 43 and the non-carbide regions 44 are alternately arranged in a stripe shape. Furthermore, in an embodiment illustrated in FIG. 4D, the embodiment illustrated in FIGS. 1A to 1D and the embodiment illustrated in FIGS. 2A to 2D are nested. In this embodiment, non-carbide regions 44 are disposed between continuous carbide regions 43 and discontinuous carbide regions 43'.

Figure 4F:
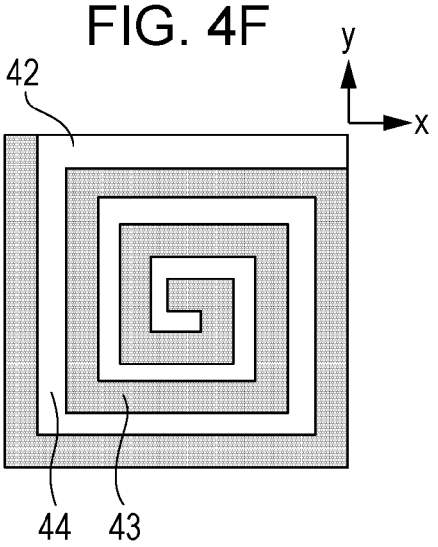

Furthermore, FIG. 4F is a diagram illustrating an embodiment in which a carbide region 43 and a non-carbide region 44 are disposed in a spiral manner. In this embodiment, although both of the carbide region 43 and the non-carbide region 44 have continuous structures, continuity of the carbide regions 43 is locally lost in a plurality of directions as a whole.

In all the embodiments illustrated in FIGS. 4A to 4F, since the carbide regions 43 are locally disposed, the thermal stress generated in the target 9 is reduced.

Furthermore, any configuration may be employed as long as the carbide regions 43 and the non-carbide regions 44 are simultaneously disposed in a range of a focus point of an electron beam, and it is not necessarily the case that sizes, forms, and arrangement density of the carbide regions 43 and the non-carbide regions 44 are uniform. For example, an embodiment in which the carbide regions 43 having different forms and sizes are randomly distributed is also included in the present invention.

Next, the lamination structure of the target 9 according to the present invention including the carbide regions 43 will be described with reference to FIGS. 1A to 1D.

First, materials of the carbide regions 43 will be described. In FIG. 1A, the carbide regions 43 which are configured by carbide of target metal function as bridges between the substrate 41 including carbon as a main component and the target layer 42 including the target metal. Accordingly, the carbide regions 43 are preferably including metal carbide of the target metal which constitutes the target layer 42 in terms of interlayer compatibility.

In terms of heat resistance of the target 9, refractory metal such as molybdenum, tantalum, or tungsten is used as the target metal. Therefore, in such an embodiment, the carbide regions 43 are preferably including carbide of molybdenum, tantalum, or tungsten.

As a crystalline form and material composition of the carbide regions 43, hexagonal dimolybdenum carbide, cubic monotantalum carbide, or hexagonal monotungsten carbide is preferably employed in terms of thermal stability.

Here, most of types of metal carbide have large linear expansion coefficients relative to pure metal which is not carbonated. The relationship of the linear expansion coefficients described above is also true for metal carbide selected from the group of molybdenum, tantalum, and tungsten as illustrated in Table 1, and a difference between the linear expansion coefficients becomes a driving force of the thermal stress between the substrate 41 which has a small linear expansion coefficient and the carbide regions 43. Accordingly, since the carbide regions 43 and the non-carbide regions 44 which have small linear expansion coefficients relative to the carbide regions 43 are disposed in a mixed manner, an effect of reduction of the thermal stress generated in the target 9 is obtained.

TABLE 1

| | Metal | | | | |
|---|---|---|---|---|---|
| | Cr | Zr | Mo | Ta | W |
| Linear Expansion Coefficient (μm/m/K) | 4.5 | 5.7 | 4.8 | 6.3 | 4.5 |
| | Metal Carbide | | | | |
| | $Cr_3C_2$ | ZrC | $Mo_2C$ | TaC | WC |
| Linear Expansion Coefficient (μm/m/K) | 10.3 | 6.7 | 7.8 | 8.0 | 5.8 |
| Temperature (K) | 300 | 300 | 300 | 300 | 300 |

Furthermore, most of types of metal carbide have low thermal conductivities relative to pure metal which is not carbonated. The relationship of the thermal conductivity is also true for metal carbide selected from the group of molybdenum, tantalum, and tungsten as illustrated in Table 2, and a difference between thermal conductivities causes heat resistance generated between the substrate 41 which has a high thermal conductivity and the carbide regions 43 which has a low thermal conductivity. Accordingly, since the carbide regions 43 and the non-carbide regions 44 which have high thermal conductivities relative to the carbide regions 43 are disposed in a mixed manner, an effect of reduction of the heat resistance generated in a direction of a thickness of the target 9 is obtained.

TABLE 2

| | Metal | | | | |
|---|---|---|---|---|---|
| | Cr | Zr | Mo | Ta | W |
| Thermal Conductivity (W/m/K) | 90.3 | 22.7 | 138 | 57.5 | 178 |
| | Metal Carbide | | | | |
| | $Cr_3C_2$ | ZrC | $Mo_2C$ | TaC | WC |
| Thermal Conductivity (W/m/K) | 190 | 20.5 | 21.5 | 22.2 | 84.2 |
| Temperature (K) | 300 | 300 | 300 | 300 | 300 |

In terms of stability of the carbide regions 43, thicknesses of the target layer 42 and the carbide regions 43 are preferably set taking the electron intrusion depth dp to the target layer 42 at a time of operation of the target 9 into consideration. The preferred layout relationship between the target layer 42 and the carbide regions 43 will be described in detail hereinafter with reference to FIG. 1D.

The thickness of the target layer 42 may be 1.05 times to twice the electron intrusion depth dp which is a reference defined by the X-ray tube voltage Va of X-ray generating tube 102. With this configuration, electron scattering damages or heat damages to the carbide regions 43 are suppressed, and simultaneously, a property of forward transmission of X-ray generated in the target layer 42 is attained. A range of the electron intrusion depth dp corresponds to a heat section of the target 9, and therefore, the carbide regions 43 are preferably not arranged in a region from a surface of the target layer 42 to a level of the electron intrusion depth dp in terms of heat resistance and suppression of composition variation of the carbide regions 43.

In general, the electron intrusion depth dp is determined in accordance with an incident energy Ep (eV) or the X-ray tube voltage Va (V) and density of the target layer 42. In the present invention, the electron intrusion depth dp (m) is defined by the following general formula 1 which is in excellent agreement with actual measurement in the X-ray tube voltage Va in a range from 10 kV to 1000 kV (corresponding to an incident electron energy Ep in a range from $1\times10^4$ eV to $1\times10^6$ eV): $dp=6.67\times10^{-10}\times Va^{1.6}/\rho$ (general formula 1). Here, Va represents the X-ray tube voltage (V) and ρ represents density ($kg/m^3$) of the target layer 42. Furthermore, although the density ρ of the target layer 42 may be determined by weighing and length measurement of the thickness of the target layer 42, a method for determining the density ρ by Rutherford backscattering spectrometry analysis method (RBS method) is preferably used as a method for measuring density of a thin film.

In the present invention, the thickness of the target layer 42 is defined to be a range from an electron incident surface of the target layer 42 to a boundary surface $P_{BTM}$ of the substrate 41. In the embodiment illustrated in FIG. 1D, assuming that the thickness of the target layer 42 is 5.5 μm and the thickness of the carbide regions 43 is 100 nm, the carbide regions 43 may be disposed in positions sufficiently separated from a heat region generated by intrusion of electrons into the target layer 42.

Here, in an operation condition in which the target layer 42 is including tungsten and the X-ray tube voltage Va is 100 kV, the electron intrusion depth dp in the target layer 42 is 3.5 μm. Accordingly, the thickness of the target layer 42 corresponds to 1.6 times the electron intrusion depth dp, and the thickness of the carbide regions 43 corresponds to 0.03 times the electron intrusion depth dp.

If the thickness and positions $P_{TOP}$ and $P_{BTM}$ of a surface and the boundary surface, respectively, which are shape parameters relating to the target layer 42 have variation, each of the parameters may be uniquely determined by performing addition average in the electron irradiation region F.

Next, a preferred distribution of the carbide regions 43 in a film surface direction will be described. When the carbide regions 43 are disposed between the substrate 41 and the target layer 42, a static adhesive property between the substrate 41 and the carbide regions 43 is improved since anchoring operation is obtained due to carbon-carbon bond. However, if the carbide regions 43 are disposed in the entire electron irradiation region F, thermal stress which shears the target layer 42 and the substrate 41 in a direction of the boundary surface may not be reduced. Therefore, an area including the carbide regions 43 included in the electron irradiation region F preferably has an area density of approximately 20% to approximately 80% of an area of the electron irradiation region F (electron beam focus point).

In this embodiment, area density of the carbide regions 43 is determined by "(Acx/Apx)×(Acy/Apy)" where "Apx"

denotes an X direction array pitch, "Acx" denotes an average length of the carbide regions 43 in an X direction, "Apy" denotes Y direction array pitch, and "Acy" denotes an average length of the carbide regions 43 in a Y direction. Specifically, in this embodiment, the area density of the carbide regions 43 corresponds to a product of line densities in the X and Y directions.

Accordingly, in a case where the carbide regions 43 are isotropically provided in a discrete manner without particular anisotropy in a region between the target layer 42 and the substrate 41, the area density of the carbide regions 43 is determined to be square of the line density of the carbide regions 43. The line density of the carbide regions 43 is obtained by analyzing a cross section of the target 9 so that composition mapping is obtained.

Furthermore, in this embodiment, the area density of the carbide regions 43 is determined by "1−(Anx/Apx)×(Any/Apy)" where "Apx" denotes an X direction array pitch, "Anx" denotes an average length of the non-carbide regions 44 in an X direction, "Apy" denotes a Y direction array pitch, and "Any" denotes an average length of the non-carbide regions 44 in a Y direction.

Accordingly, in a case where the non-carbide regions 44 are isotropically provided in a discrete manner without particular anisotropy in a portion between the target layer 42 and the substrate 41, the area density of the non-carbide regions 44 is determined to be a value obtained by subtracting square of the line density of the non-carbide regions 44 from 1. The line density of the non-carbide regions 44 is obtained by analyzing a cross section of the target 9 so that composition mapping is obtained.

Next, a preferable thickness of the carbide regions 43 will be described with reference to FIG. 1A. If the thickness of the carbide regions 43 is considerably small, the anchoring operation between the substrate 41 and the target layer 42 is not sufficient, and therefore, an adhesion property between the target layer 42 and the substrate 41 is not attained. Accordingly, the thickness of the carbide regions 43 is preferably at least equal to or larger than approximately 10 atomic layers, that is, equal to or larger than 1 nm, and more preferably, equal to or larger than 10 nm.

On the other hand, an upper limit of the thickness of the carbide regions 43 is determined, firstly, as illustrated in FIG. 1D, in accordance with a demand in which upper ends of the carbide regions 43 in a thickness direction are located in positions deeper than the electron intrusion depth dp at a time of operation of the target layer 42. The upper limit of the thickness of the carbide regions 43 is determined, secondary, in accordance with a demand of a coefficient of heat transfer from the target layer 42 to the substrate 41 taking a heat transfer coefficient of the metal carbide illustrated in Table 2 into consideration. Specifically, the thickness of the carbide regions 43 is preferably equal to or smaller than 1 μm, and more preferably, equal to or smaller than 0.1 μm.

Methods for forming the target layer 42 and the carbide regions 43 are not limited to specific methods and any film formation method may be used as long as the target layer 42 and the carbide regions 43 are formed on the substrate 41 with the film thicknesses and the distribution states described above. For example, a vapor phase deposition method such as a chemical vapor phase growth method, a vapor deposition method, or a pulse laser deposition method (a PLD method), a liquid phase deposition method such as a screen printing method, a dipping method, or an ink-jet method may be used.

Methods for fabricating the target 9 according to the present invention are not limited to specific fabrication methods and any fabrication method including methods described below may be used as long as the target 9 is formed between the substrate 41 and the target layer 42 in a state in which the carbide regions 43 and the non-carbide regions 44 are formed in a mixed manner.

The target 9 according to the present invention may be formed by forming the target layer 42 or a layer serving as a precursor of the target layer 42 on the substrate 41 so that a lamination layer is obtained, and thereafter, baking the lamination layer obtained by the film formation process so that carbon derived from the substrate 41 is dispersed in the precursor. The formation of the carbide regions 43 by heating is performed under a reduced-pressure atmosphere or an inert gas atmosphere. The structure in which the carbide regions 43 and the non-carbide regions 44 are mixed may be determined considering appropriately controlling heating conditions including a heating time and heating temperature depending on materials and densities of the substrate 41 and the target layer 42.

For example, in order to obtain a structure including the carbide regions 43 including tungsten carbide and the non-carbide regions 44 including tungsten in a mixed manner, heating is performed for 5 to 60 minutes in a temperature in a range from 920 degrees C. to 1000 degrees C.

Furthermore, the carbide regions 43 may be formed by discretely depositing metal regions on the substrate 41, performing a heating process, a plasma process, and the like in a carbon content gas atmosphere, and introducing carbon from a vapor phase into the metal regions.

EXAMPLES

Next, an X-ray generating apparatus including the target 9 according to the present invention is fabricated by a procedure described below, and the X-ray generating apparatus is operated so that output stability is evaluated.

First Example

Figure 5A:
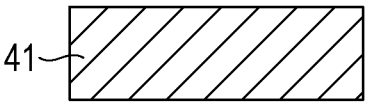
FIG. 5A to 5E are sectional views schematically illustrating steps of a method for fabricating the target according to a first example.
Figure 5D:
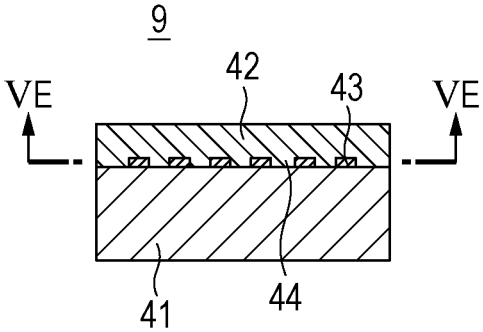

A schematic view of the target 9 fabricated in a first example is illustrated in FIG. 5D. Furthermore, a fabrication procedure of the target 9 in this example is illustrated in FIGS. 5A to 5E. Furthermore, a schematic structure of the X-ray generating tube 102 including the target 9 of this example is illustrated in FIG. 3A, and the X-ray generating apparatus 101 including the X-ray generating tube 102 is illustrated in FIG. 3B. Furthermore, an evaluation system for evaluating stability of X-ray output of the X-ray generating apparatus 101 of this example is illustrated in FIG. 6.

First, as illustrated in FIG. 5A, the substrate 41 including a disk-shaped single-crystal diamond having a diameter of 2.54 mm and a thickness of 1 mm is provided. Next, the substrate 41 is subjected to a cleaning process so as to remove remaining organic matter on a surface thereof by an UV ozone asher apparatus.

Figure 5B:
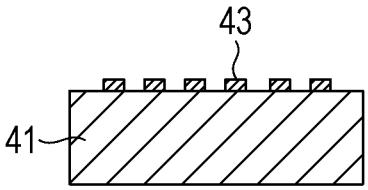
Figure 5C:
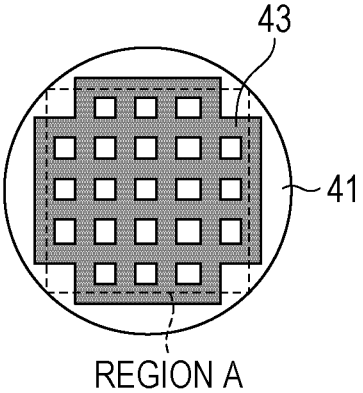
Figure 6:
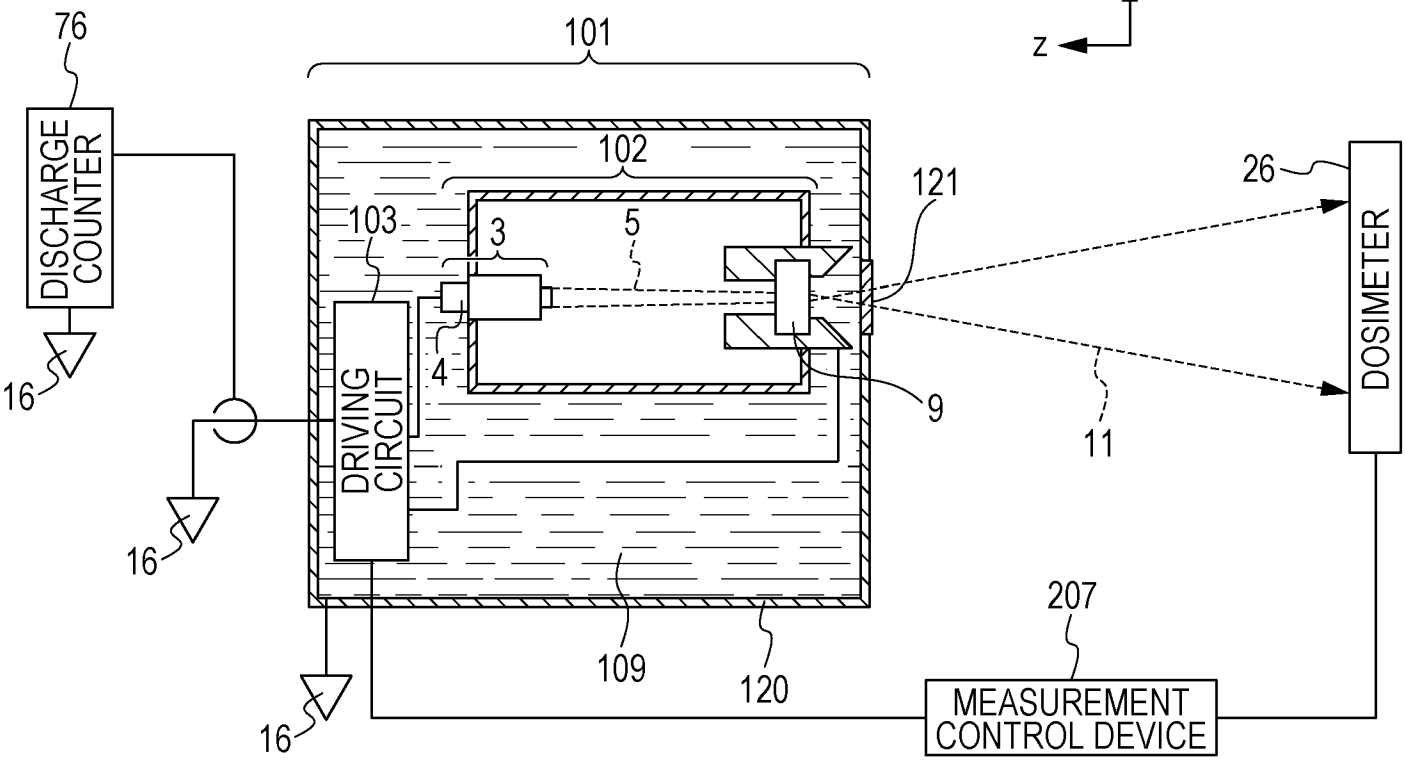
FIG. 6 is a diagram schematically illustrating a configuration of a measuring system which measures X-ray output intensity of the X-ray generating apparatus according to the first example.

Thereafter, as illustrated in FIG. 5B, the carbide regions 43 which are including monotungsten carbide (WC) and which have a thickness of 100 nm are deposited by a sputtering method on one of opposite surfaces of the substrate 41. In the sputter deposition, a metal mask is formed on the substrate 41 and the carbide regions 43 are formed as a grid pattern as illustrated in FIG. 5C. Area density of the obtained pattern of the carbide regions 43 is 75%.

The area density of the carbide regions 43 which have been patterned is determined by a region A which overlaps with the focus point of an electron beam at a time of operation of the target 9, and a peripheral portion of the substrate 41 is not included. The region A is a square range having sides of 1.7 mm and corresponds to a range surrounded by a dotted line in FIG. 5C.

The carbide regions 43 are formed by the sputtering method while argon is used as carrier gas, a target source of the monotungsten carbide (WC) is used, and the substrate 41 is heated to 260 degrees C.

Subsequently, as illustrated in FIG. 5D, the target layer 42 having a thickness of 5.5 μm is including tungsten by sputtering using argon as carrier gas on the surface of the substrate 41 including the carbide regions 43. A temperature of the target layer 42 at a time when the target layer 42 is formed is 260 degrees C. which is the same as that in the preceding process.

Figure 5E:
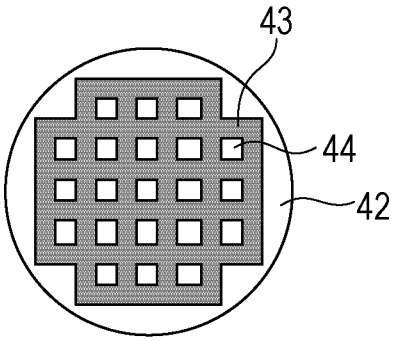

In this way, the target 9 including the carbide region 43 of the grid pattern is fabricated as illustrated in FIGS. 5D and 5E. FIG. 5E is a sectional view taken along an instruction line VE illustrated in FIG. 5D. It is found that, when height distribution is observed on a surface of the target layer 42 of the fabricated target 9 using a laser interferometer, the height distribution of the surface of the target layer 42 is 15 nm which is leveled to sufficiently smaller than the thickness of the carbide region 43.

Note that the thicknesses of the carbide region 43 and the target layer 42 are controlled to predetermined thicknesses by controlling calibration curve data obtained in advance using thicknesses of the formed layers and periods of time in which the layers are formed before the deposition processes are performed and periods of time in which the deposition processes are performed. Measurement of the thicknesses of the layers for obtaining the calibration curve data is performed using a spectroscopic ellipsometer UVISEL ER fabricated by Horiba, Ltd.

A cross-section sample S1 of the target 9 which includes boundary surfaces of the target layer 42, the carbide regions 43, and the substrate 41 is fabricated. In the fabrication of the cross-section sample S1, a dicing process and an FIB process are performed in combination.

In the cross-section sample S1, mapping of composition and a crystal structure around a boundary surface between the target layer 42 and the substrate 41 is performed using a transmission electron microscope (TEM) and electron diffraction (ED) in combination. According to the obtained composition mapping, regions including monotungsten carbide (WC) and regions including tungsten are alternately arranged with widths of 180 μm. A thickness of the regions including the monotungsten carbide is 100 nm.

Thereafter, the X-ray generating tube 102 including the target 9 fabricated in this example is fabricated in the following procedure.

Figure 5F:
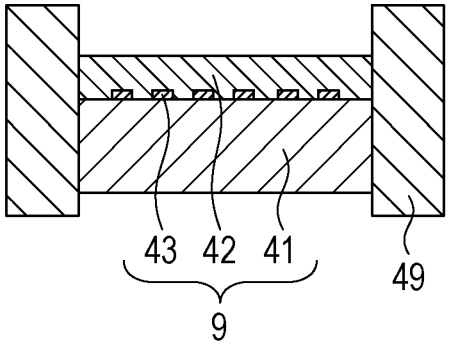
FIG. 5F is a sectional view schematically illustrating an anode incorporating the target of the first example.

First, a tubular anode member 49 including tungsten is provided. Subsequently, as illustrated in FIG. 5F, the target 9 is fixed inside an opening of the anode member 49 using brazing filler metal. Ohmic contact between the target layer 42 and the anode member 49 is confirmed. An anode including the target 9 is fabricated as described above.

Thereafter, the electron emitting source 3 formed by an impregnation type electron gun including the electron emitting portion 2 formed by lanthanum boride (LaB6) is welded to a cathode member formed by kovar, not illustrated, so that a cathode is formed.

Furthermore, the envelope is formed by brazing the cathode and the anode to respective openings of the insulation tube 110 including alumina. Subsequently, the inner space 13 of the envelope is evacuated using an exhaust apparatus, not illustrated, so that a degree of vacuum of $1\times10^{-6}$ Pa is obtained. The X-ray generating tube 102 illustrated in FIG. 3A is fabricated as described above.

Furthermore, the driving circuit 103 is electrically connected to the cathode and the anode of the X-ray generating tube 102, and in addition, the X-ray generating tube 102 and the driving circuit 103 are accommodated in the accommodation container 120 so that the X-ray generating apparatus 101 illustrated in FIG. 3B is fabricated.

Next, an evaluation system 70 illustrated in FIG. 6 is provided so as to evaluate driving stability of the X-ray generating apparatus 101. The evaluation system 70 includes a detection system which evaluates stability using an X-ray imaging system 60 illustrated in FIG. 3C as a base. The evaluation system 70 includes a dosimeter 26 in a forward position by 1 m relative to the X-ray transmission window 121 of the X-ray generating apparatus 101. The dosimeter 26 is connected to the driving circuit 103 through a measurement control device 207 so as to be capable of measuring irradiation output intensity of the X-ray generating apparatus 101.

As a driving condition in the evaluation of the driving stability, the X-ray tube voltage Va of the X-ray generating tube 102 is +100 kV, a current density of an electron beam irradiated to the target layer 42 is 5 mA/mm$^2$, and an electron irradiation period of 2 seconds and non-irradiation period of 98 seconds are alternately repeated in pulse driving. As the detected X-ray output intensity, an average value for one second in the middle of the electron irradiation period is employed.

The stability evaluation of the X-ray output intensity is performed by a retention rate obtained by standardizing X-ray output intensity obtained 100 hours after X-ray output is started by initial X-ray output intensity.

Before the stability evaluation of the X-ray output intensity is performed, the X-ray tube current supplied from the target layer 42 to a ground electrode 16 is measured and constant current control is performed by a negative feedback circuit, not illustrated, such that electron current density of an electron irradiated to the target layer 42 has a value variable within 1%. Furthermore, during the stability driving evaluation of the X-ray generating apparatus 101, stable driving performed without discharging is confirmed using a discharge counter 76.

The retention rate of the X-ray output of the X-ray generating apparatus 101 of this example is 0.98. In the X-ray generating apparatus 101 including the target 9 of this example, even after long drive history, remarkable variation of X-ray output is not recognized and it is determined that the stable X-ray output intensity is obtained.

When density of the target layer 42 of this example measured by an RBS method is $19.2\times10^3$ (kg/m$^3$). As a result, the electron intrusion depth dp of the target layer 42 relative to the incident electrons having kinetic energy of 100 keV is determined to be $3.5\times10^{-6}$ (m). Accordingly, in the X-ray generating tube 102 operating in the X-ray tube voltage Va of 100 kV, at least a range of the electron intrusion depth dp from the surface of the target layer 42 does not overlap with the carbide regions 43 including monotungsten carbide.

Second Example

A method for fabricating the X-ray generating apparatus 101 used in a second example is the same as that of the first example except that "the target layer 42 is formed on the substrate 41 so that the lamination layer is formed, and thereafter, the lamination layer is heated" instead of the process of forming the carbide regions 43 by sputtering. After the fabrication of the X-ray generating apparatus 101, stability of X-ray output of the X-ray generating apparatus 101 is evaluated.

The carbide regions 43 obtained by the fabrication method of this example are formed such that island-shaped regions having different sizes are discretely disposed in a plane which is parallel to the boundary surface.

Hereinafter, a procedure of fabrication of the target 9 of this example will be described. First, as with the first example, the substrate 41 including a disk-shaped single-crystal diamond having a diameter of 2.54 mm and a thickness of 1 mm is provided. Next, the substrate 41 is subjected to a cleaning process so as to remove remaining organic matter on a surface thereof by an UV ozone asher apparatus.

Subsequently, the target layer 42 having a thickness of 5.5 μm is including tungsten by sputtering using argon as carrier gas on one of opposite surfaces of the substrate 41. A temperature of the target layer 42 at a time when the target layer 42 is formed is 260 degrees C. By this process, a lamination layer, not illustrated, including the substrate 41 and the target layer 42 is obtained.

Next, the lamination layer is disposed in a vacuum pressure reducing chamber, not illustrated, and a baking process is performed such that the lamination layer is heated under a temperature of 940 degrees C. for 20 minutes while a vacuum degree equal to or smaller than $1\times10^{-5}$ Pa is maintained in the chamber. In this way, the target 9 of this example is fabricated.

A cross-section sample S2 which is obtained by processing the target 9 which has been subjected to the baking process to have a size including a boundary surface between the target layer 42 and the substrate 41 is provided. Furthermore, a cross-section sample S3 which is parallel to the boundary surface between the substrate 41 and the target layer 42 is provided. As with the first example, the cross-section samples S2 and S3 are subjected to the dicing process and the FIB process.

Mapping of composition distribution and a crystal structure distribution around the boundary surface between the target layer 42 and the substrate 41 is performed on the cross-section samples S2 and S3 using the TEM and the ED in combination. As a result, a distribution state in which the carbide regions 43 having boundary surfaces including monotungsten carbide (WC) and diamond are distributed in portions among the non-carbide regions 44 having boundary surfaces including tungsten and diamond is recognized.

Furthermore, sizes of the observed carbide regions 43 including monotungsten carbide (WC) are within a range from 30 nm to 260 nm, gaps among the carbide regions 43 are within a range from 150 nm to 800 nm, and the carbide regions 43 are distributed in an isolated manner. Area density of the carbide regions 43 of the target 9 of this example is 32%.

Next, the X-ray generating tube 102 and the X-ray generating apparatus 101 are fabricated using the target 9 of this example in a procedure the same as that of the first example. The fabricated X-ray generating apparatus 101 is incorporated in the evaluation system 70 illustrated in FIG. 6 which measures driving stability.

The retention rate of X-ray output of the X-ray generating apparatus 101 of this example is 0.98. In the X-ray generating apparatus 101 including the target 9 of this example, even after long drive history, remarkable variation of X-ray output is not recognized and it is determined that the stable X-ray output intensity is obtained.

Density of the target layer 42 of this example measured by an RBS method is $19.0\times10^{3}$ (kg/m$^3$). As a result, the electron intrusion depth dp in the target layer 42 relative to the incident electrons having kinetic energy of 100 keV is determined to be $3.5\times10^{-6}$ (m). Accordingly, according to the X-ray generating tube 102 operating in the X-ray tube voltage Va of 100 kV, a range of the electron intrusion depth dp from the surface of the target layer 42 does not overlap with the carbide regions 43.

Third Example

A method for fabricating the X-ray generating apparatus 101 used in a third example is the same as that of the second example except that the lamination layer in which the carbide regions 43 are to be formed is heated for 50 minutes. After the fabrication of the X-ray generating apparatus 101, stability of X-ray output of the X-ray generating apparatus 101 is evaluated.

A cross-section sample S4 which is obtained by processing the target 9 fabricated in this example to have a size including the boundary surface between the target layer 42 and the substrate 41 is provided. Furthermore, a cross-section sample S5 which is parallel to the boundary surface between the substrate 41 and the target layer 42 is provided. As with the first example, the cross-section samples S4 and S5 are processed by the dicing process and the FIB process.

Mapping of composition distribution and a crystal structure distribution around the boundary surface between the target layer 42 and the substrate 41 is performed on the cross-section samples S4 and S5 using the TEM and the ED in combination. As a result, a distribution state in which the non-carbide regions 44 having boundary surfaces including tungsten and diamond are distributed in portions among the carbide regions 43 having boundary surfaces including monotungsten carbide (WC) and diamond is recognized.

Furthermore, sizes of the observed non-carbide regions 44 are within a range from 60 nm to 290 nm, and gaps among the non-carbide regions 44 are within a range from 170 nm to 600 nm, and the non-carbide regions 44 are distributed in an isolated manner. Area density of the carbide regions 43 of the target 9 of this example is 74%.

The retention rate of the X-ray output of the X-ray generating apparatus 101 of this example is 0.95. In the X-ray generating apparatus 101 including the target 9 of this example, even after long drive history, remarkable variation of X-ray output is not recognized and it is determined that the stable X-ray output intensity is obtained.

Density of the target layer 42 of this example measured by the RBS method is $18.9\times10^{3}$ (kg/m$^3$). As a result, the electron intrusion depth dp in the target layer 42 relative to the incident electrons having kinetic energy of 100 keV is determined to be $3.5\times10^{-6}$ (m). Accordingly, in the X-ray generating tube 102 operating in the X-ray tube voltage Va of 100 kV, a range of the electron intrusion depth dp from the surface of the target layer 42 does not overlap with the carbide regions 43.

Fourth Example

Figure 3C:
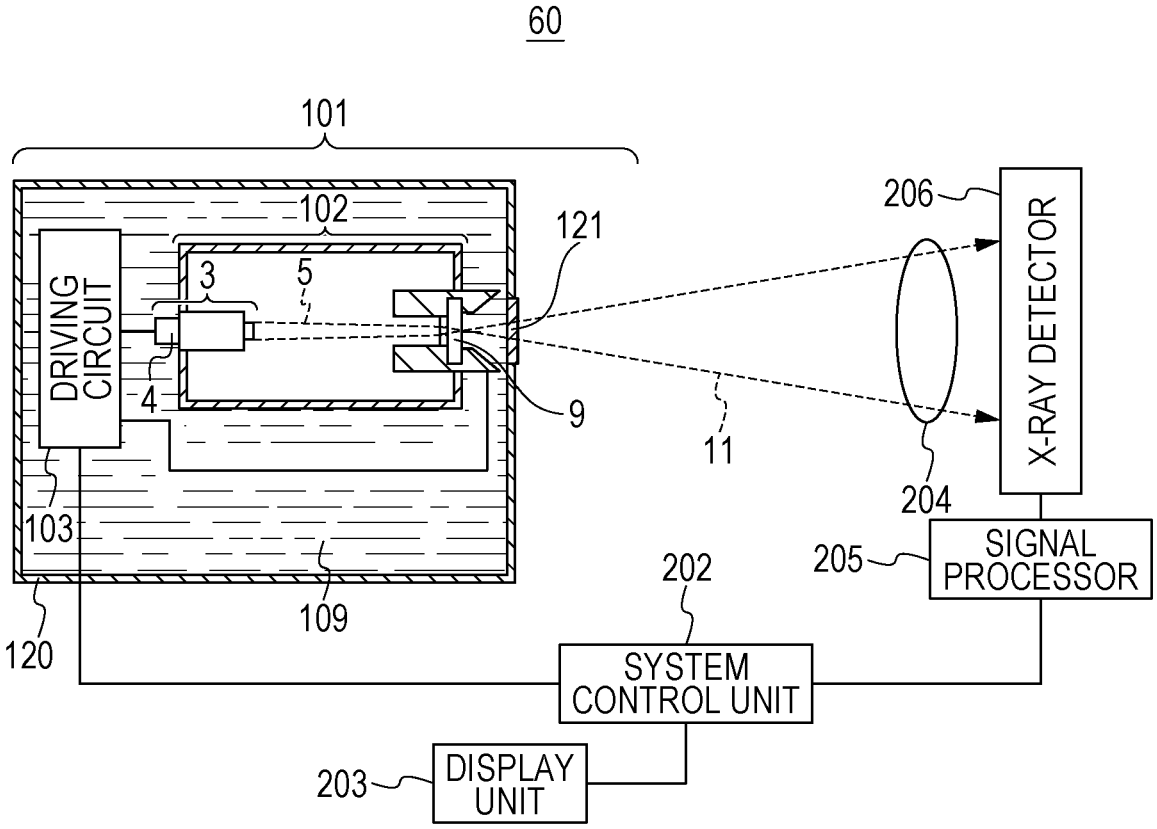
FIG. 3C is a diagram illustrating a configuration of an X-ray imaging system to which the target is applied.

In a fourth example, the X-ray imaging system 60 illustrated in FIG. 3C is fabricated using the X-ray generating apparatus 101 according to the first example.

Since the X-ray imaging system 60 of this example includes the X-ray generating apparatus 101 in which variation of X-ray output is suppressed, an X-ray photographing image having a high signal-to-noise ratio may be obtained.

Note that, although the distribution of the carbide regions 43 and the composition and the crystal form of the carbide regions 43 are identified by the electron diffraction method (the ED method) in the first to third examples, other analysis methods may be used as long as carbon is identified. The other analysis methods include electron energy-loss spectroscopy, X-ray photoelectron spectroscopy, and a Raman spectrum method.

According to the present invention, a highly reliable X-ray generating apparatus in which an adhesion property between a diamond substrate and a target layer is stably maintained may be provided. Accordingly, variation of X-ray output intensity caused by increase in temperature of the target layer may be suppressed, and an X-ray target having highly reliable X-ray output characteristics may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-125847 filed Jun. 14, 2013, which is hereby incorporated by reference herein in its entirety.

What is claimed is:

1. A transmissive target, comprising:

a target layer configured to include target metal and generate X-ray when receiving irradiated electrons; and a substrate configured to support the target layer and include carbon as a main component, a carbide region including carbide of the target metal and a non-carbide region including the target metal are located in a mixed manner between the substrate and the target layer.

2. The transmissive target according to claim 1, wherein the carbide region is locally disposed in a discontinuous manner due to existence of the non-carbide region.

3. The transmissive target according to claim 1, wherein the carbide region is locally disposed in a discontinuous manner when viewed from a plurality of directions.

4. The transmissive target according to claim 1, wherein a plurality of the carbide regions are disposed in an isolated manner on the boundary surface.

5. The transmissive target according to claim 1, wherein a plurality of the non-carbide regions are disposed in an isolated manner on the boundary surface.

6. The transmissive target according to claim 1, wherein the support substrate is including diamond or diamond-like carbon.

7. An X-ray generating tube, comprising:

the transmissive target set forth in claim 1;

an electron emitting source configured to include an electron emitting portion which irradiates a flux of electron beams to the target layer and configured to face the target layer; and an envelope configured to accommodate the electron emitting portion and the target layer in an inner space or an inner surface of the envelope.

8. The X-ray generating tube according to claim 7, wherein the carbide region is locally disposed in a discontinuous manner due to existence of the non-carbide region in an electron irradiation region formed on the target layer by the flux of electron beams.

9. An X-ray generating apparatus, comprising:

the X-ray generating tube set forth in claim 7; and a driving circuit configured to be electrically connected to the target layer and the electron emitting portion and output an X-ray tube voltage to be applied to a portion between the target layer and the electron emitting portion.

10. An X-ray imaging system, comprising:

the X-ray generating apparatus set forth in claim 9; and an X-ray detector configured to detect X-ray which has been output from the X-ray generating apparatus and which has been transmitted through a subject.

* * * * *